US010403243B2

(12) United States Patent
Ohba

(10) Patent No.: US 10,403,243 B2
(45) Date of Patent: Sep. 3, 2019

(54) SUPPORT ASSEMBLY AND KEYBOARD APPARATUS

(71) Applicant: Yamaha Corporation, Hamamatsu-shi, Shizuoka-ken (JP)

(72) Inventor: Akito Ohba, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 0 days.

(21) Appl. No.: 15/074,221

(22) Filed: Mar. 18, 2016

(65) Prior Publication Data

US 2016/0284324 A1 Sep. 29, 2016

(30) Foreign Application Priority Data

Mar. 25, 2015 (JP) ..... 2015-063274

(51) Int. Cl.
*G10C 3/18* (2006.01)
*G10C 3/24* (2006.01)
*G10C 3/22* (2019.01)

(52) U.S. Cl.
CPC *G10C 3/24* (2013.01); *G10C 3/22* (2013.01)

(58) Field of Classification Search
CPC ..... G10C 3/12; G10C 3/168; G10C 3/18
USPC ..... 84/251
See application file for complete search history.

(56) References Cited

U.S. PATENT DOCUMENTS 2,411,005 A * 11/1946 Schulze ..... G10C 3/22 84/239
3,516,325 A 6/1970 Harada et al.
4,286,493 A * 9/1981 Hardesty ..... G10C 3/22 84/237
6,232,537 B1 * 5/2001 Kimble ..... G10C 3/16 84/216
7,141,728 B2 11/2006 Yoshisue et al.
2003/0192420 A1 * 10/2003 Overs ..... G10C 3/22 84/236
2005/0028665 A1 2/2005 Tanaka
2005/0284279 A1 12/2005 Wroblewski
(Continued)

FOREIGN PATENT DOCUMENTS

DE 529922 C 7/1931
JP S49-002327 U 1/1974
JP S58-131096 U 9/1983
(Continued)

OTHER PUBLICATIONS

Extended European Search Report, dated Jul. 28, 2016, for EP Application No. 16161151.2, eight pages.
(Continued)

*Primary Examiner* — Jianchun Qin
(74) *Attorney, Agent, or Firm* — Morrison & Foerster, LLP

(57) ABSTRACT

A support assembly according to one embodiment of the present invention includes a support rotatably disposed with respect to a frame, a repetition lever rotatably connected to the support, an spring element supported by a support portion fixed to the support, the spring element which provides a rotational force to the repetition lever, and a contact portion between the repetition lever and the spring element, wherein a rotating portion of the repetition lever is provided with respect to the support portion on a side opposite to the contact portion between the repetition lever and the spring element.

20 Claims, 7 Drawing Sheets

(56) References Cited

U.S. PATENT DOCUMENTS

| | | | | |
|---|---|---|---|---|
| 2007/0068359 | A1* | 3/2007 | Wroblewski | G10C 3/22 84/236 |
| 2009/0173206 | A1* | 7/2009 | Inoue | G10C 3/22 84/243 |

FOREIGN PATENT DOCUMENTS

| | | | | |
|---|---|---|---|---|
| JP | 2005-292361 | A | | 10/2005 |
| JP | 2016012075 | A | * | 1/2016 |

OTHER PUBLICATIONS

Notification of Reasons for Refusal dated Jul. 31, 2018, for JP Application No. 2015-063274, with English machine translation, ten pages.

Chinese Office Action dated Mar. 21, 2019, for CN Application No. 201610169165.0, with English translation, 15 pages.

* cited by examiner

SUPPORT ASSEMBLY AND KEYBOARD APPARATUS

CROSS REFERENCE TO RELATED APPLICATIONS

This application is based upon and claims the benefit of priority from the prior Japanese Patent Application No. 2015-063274, filed on Mar. 25, 2015, the entire contents of which are incorporated herein by reference.

FIELD

The present invention relates to a support assembly for use in a keyboard apparatus.

BACKGROUND

Conventional acoustic pianos such as grand pianos and upright pianos are configured of many components. Also, since assembling these components is very complex, the assembling operation takes a long time. In particular, since an action mechanism provided for each key requires many components, its assembling operation is very complex.

For example, in an action mechanism described in Japanese Unexamined Patent Application Publication No. 2005-292361, a plurality of components operate together, and key operation by key pressing and key releasing is transmitted to a hammer. In particular, a support assembly configuring part of the action mechanism operates with various components assembled together. The support assembly has not only a mechanism which achieves string hammering by the hammer in accordance with key pressing but also an escapement mechanism for releasing a force transmitted to the hammer by key operation immediately before string hammering. This mechanism is an important mechanism for the basic operation of an acoustic piano. In particular, in a grand piano, a double escapement mechanism with a repetition lever and a jack combined together is generally adopted.

The operation of the action mechanism provides a sense (hereinafter referred to as a touch feeling) to a finger of a player through the key. In particular, the structure of the support assembly has an important influence on the touch feeling. For example, the touch feeling by the operation of the escapement mechanism is called let-off.

Since the number of respective components making up the support assembly is large, the manufacturing period is prolonged, and manufacturing cost increased. Therefore, to reduce manufacturing cost, it is desired to simply decrease the number of components and the structure. However, if the structure of the support assembly is changed, the touch feeling at the time of key operation is greatly changed. Therefore, it is difficult to decrease the expense of manufacturing an acoustic piano.

SUMMARY

One object of the present invention is to reduce manufacturing cost of a support assembly while decreasing a change in touch feeling at the time of key operation, compared with a keyboard apparatus of an acoustic piano.

According to one embodiment of the present invention, a support assembly is provided which includes a support rotatably disposed with respect to a frame, a repetition lever rotatably connected to the support, an spring element supported by a support portion fixed to the support, the spring element providing a rotational force to the repetition lever, and a contact portion between the repetition lever and the spring element, wherein a rotating portion of the repetition lever is provided with respect to the support portion on a side opposite to the contact portion between the repetition lever and the spring element.

The rotating portion of the repetition lever may be provided on an extension line of a straight line connecting the support portion and the contact portion.

The contact portion may include a protrusion.

In a rotation range of the repetition lever, a position may be provided where the repetition lever and the spring element become parallel to each other.

The spring element may be a wire spring.

In a rotation range of the repetition lever, the repetition lever and the straight-line-shaped portion of the spring element may be positioned at an angle in a range equal to or larger than 0° and equal to or smaller than 20°.

The rotating portion of the repetition lever may include a flexible region.

The region with flexibility of the repetition lever may be a spring element.

The support may include a resin structure.

The jack may include a resin structure.

Also, according to one embodiment of the present embodiment, a keyboard apparatus may be provided, which includes a plurality of the support assemblies according to claim 1, keys disposed correspondingly to the respective support assemblies to rotate the support, and a sound emission mechanism which emits sound in accordance with key pressing.

The sound emission mechanism may include a sound source unit generating a sound signal in accordance with key pressing.

The sound emission mechanism may include a string generating a sound by colliding a hammer in accordance with key pressing.

REFERENCE SIGNS LIST

Figure 1:
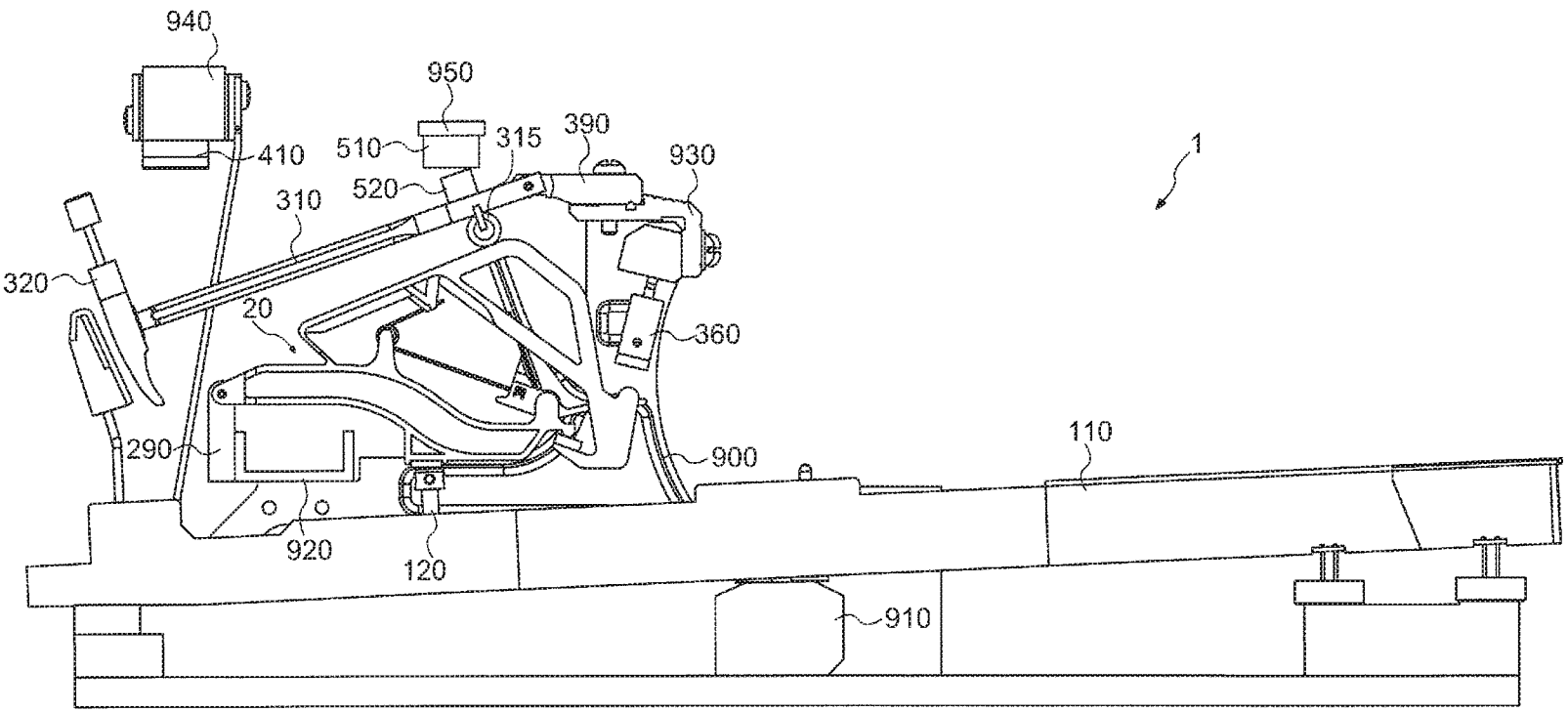
FIG. 1 is a side view depicting the structure of a keyboard apparatus in one embodiment of the present invention.

1 . . . keyboard apparatus, 110 . . . key, 20 . . . support assembly, 210 . . . support, 2101 . . . first main body portion, 2102 . . . bent portion, 2103 . . . second main body portion, 2105 . . . jack support portion, 2109 . . . through hole, 212 . . . support heel, 216 . . . stopper, 218 . . . spring support portion, 220 . . . flexible portion, 240 . . . repetition lever, 242 . . . spring contact portion, 2421 . . . spring contact top portion, 2422 . . . curved-surface portion, 2423 . . . spring contact side portion, 2425 . . . spring contact side portion, 244 . . . extension portion, 2441 . . . inner portion, 2442 . . . outer section, 2443 . . . coupling portion, 2444 . . . stopper contact portion, 250 . . . jack, 2502 . . . large jack, 2504 . . . small jack, 2505 . . . support connecting portion, 280 . . . torsion coil spring, 2802 . . . first arm, 2804 . . . second arm, 290 . . . support flange, 310 . . . hammer shank, 315 . . . hammer roller, 320 . . . hammer, 346 . . . repetition regulating screw, 360 . . . regulating button, 390 . . . shank flange, 410 . . . hammer stopper, 50 . . . sound emission mechanism, 510 . . . sensor, 520 . . . shielding plate, 550 . . . signal converting unit, 560 . . . sound source unit, 570 . . . output unit, 900 . . . bracket, 910 . . . balance rail, 920 . . . frame, 930 . . . shank rail, 940 . . . hammer stopper rail, 950 . . . sensor rail, 960 . . . frame

DESCRIPTION OF EMBODIMENTS

In the following, a keyboard apparatus including a support assembly in one embodiment of the present invention is described in detail with reference to the drawings. Embodiments described below are merely examples of embodiments of the present invention, and the present invention should not be interpreted to be restricted to these embodiments. Note that, in the drawings referred to in the present embodiments, identical portions or portions having a similar function are provided with a same sign or similar sign (sign with a numeral merely followed by A, B, or the like), and repetitive description thereof may be omitted. Also, for convenience of description, the dimensional ratio in the drawings (such as ratio between respective structures, or a ratio among length) may differ from an actual ratio, and part of the structure may be omitted from the drawings.

<Embodiments>

[Structure of Keyboard Apparatus 1]

A keyboard apparatus 1 in one embodiment of the present invention is an example obtained by applying one example of the support assembly according to the present invention to an electronic piano. To obtain a touch feeling close to a grand piano at the time of key operation, this electronic piano includes a structure similar to a support assembly included in a grand piano. By using FIG. 1, a general outline of the keyboard apparatus 1 according to one embodiment of the present invention is described.

FIG. 1 is a side view depicting a mechanical structure of the keyboard apparatus according to one embodiment of the present invention. As depicted in FIG. 1, the keyboard apparatus 1 according to one embodiment of the present invention includes a plurality of keys 110 (in this example, eighty-eight keys) and an action mechanism for each of the keys 110. The action mechanism includes a support assembly 20, a hammer shank 310, a hammer 320, and a hammer stopper 410. Note that while FIG. 1 depicts the case in which the key 110 is white key, the key may be a black key. Also, in the following description, terms representing orientations such as a forward side, a deeper side, upward, downward, and sideward from a player are defined as orientations when the keyboard apparatus is viewed from a player's side. For example, in the example of FIG. 1, the support assembly 20 is disposed on a player's forward side when viewed from the hammer 320, and is disposed upward when viewed from the key 110. Sideward corresponds to a direction in which the keys 110 are arranged.

The key 110 is rotatably supported by a balance rail 910. The key 110 rotates in a range from a rest position depicted in FIG. 1 to an end position. The key 110 includes a capstan screw 120. The support assembly 20 is rotatably connected to a support flange 290, and is resting on the capstan screw 120. The support flange 290 is fixed to a frame 920. Detailed structure of the support assembly 20 will be described further below. Note that the support flange 290 and the support rail 920 are one example of a frame serving as a reference of rotation of the support assembly 20. The frame may be formed of a plurality of members, such as the support flange 290 and the support rail 920, or may be formed of one member. The frame may be, as with the support rail 920, a rail-shaped member with a long side in the arrangement direction of the keys 110, or may be, as with the support flange 290, an independent member for each key 110.

The hammer shank 310 is rotatably connected to a shank flange 390. The hammer shank 310 includes a hammer roller 315. The hammer shank 310 is mounted on the support assembly 20 via the hammer roller 315. The shank flange 390 is fixed to a shank rail 930. The hammer 320 is fixed to an end of the hammer shank 310. A regulating button 360 is fixed to the shank rail 930. The hammer stopper 410 is fixed to a hammer stopper rail 940 disposed at a position of regulating rotation of the hammer shank 310.

A sensor 510 is a sensor for measuring the position and moving speed (speed immediately before the hammer shank 310 collides with the hammer stopper 410) of the hammer shank 310. The sensor 510 is fixed to a sensor rail 950. In this example, the sensor 510 is a photo interrupter. In accordance with the amount of shielding the optical axis of the photo interrupter by a shielding plate 520 fixed to the hammer shank 310, an output value from the sensor 510 is changed. Based on this output value, the position and moving speed of the hammer shank 310 can be measured. Note that a sensor for measuring an operating state of the key 110 may be provided in place of the sensor 510 or together with the sensor 510.

The above-described frame 920, shank rail 930, hammer stopper rail 940, and sensor rail 950 are supported by a bracket 900.

[Structure of Support Assembly 20]

Figure 2:
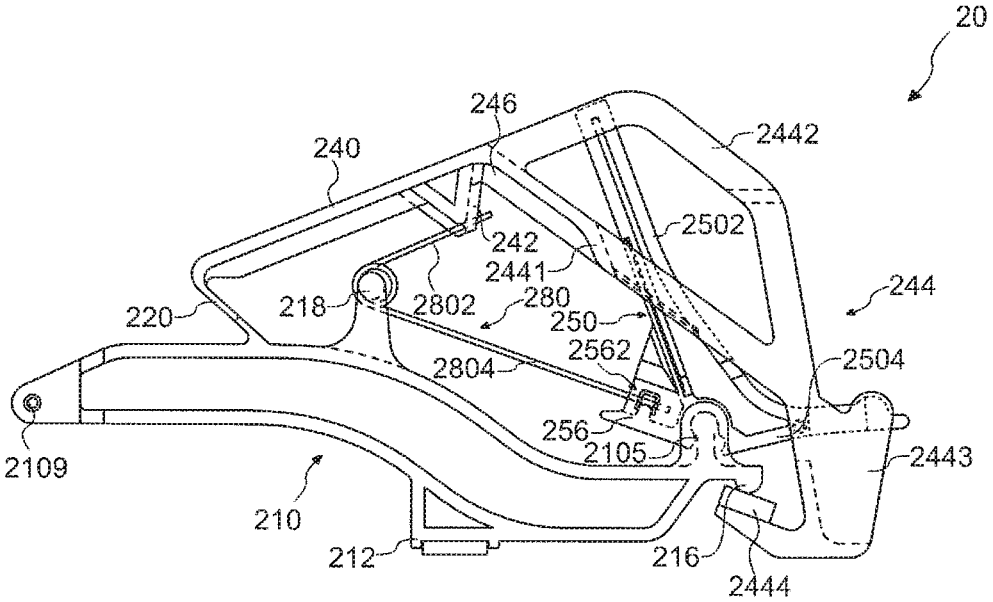
FIG. 2 is a side view depicting the structure of a support assembly in one embodiment of the present invention.
Figure 3A:
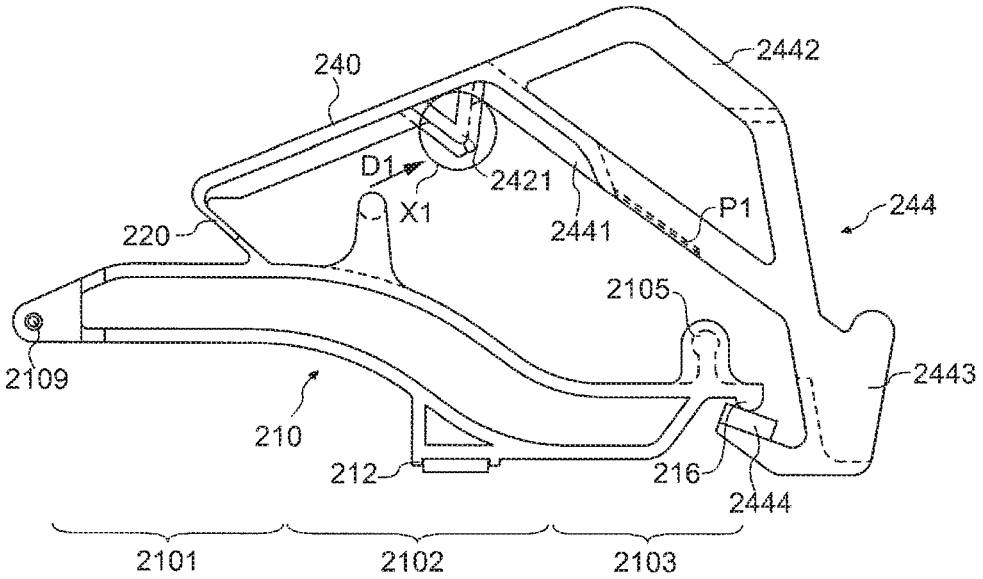
FIG. 3A is a side view depicting a partial structure of the disassembled support assembly in one embodiment of the present invention.
Figure 3B:
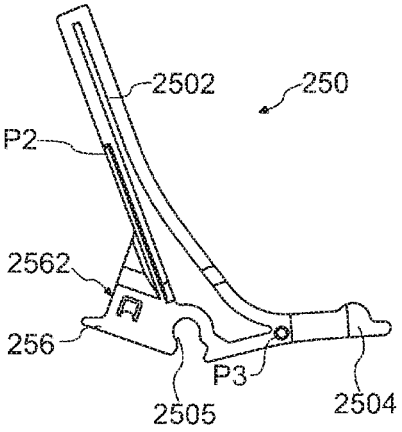
FIG. 3B is a side view depicting a partial structure of the disassembled support assembly in one embodiment of the present invention.
Figure 3C:
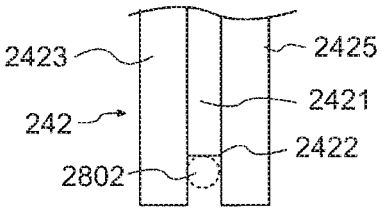
FIG. 3C is a side view depicting a partial structure of the disassembled support assembly in one embodiment of the present invention.

FIG. 2 is a side view depicting the structure of the support assembly in one embodiment of the present invention. FIG. 3A to FIG. 3C are side views each depicting a partial structure of the disassembled support assembly in one embodiment of the present invention. For easy understanding of the features of each component, FIG. 3A is a drawing in which a jack 250 and a torsion coil spring 280 are excluded from the support assembly 20. FIG. 3B is a drawing only depicting the jack 250.

The support assembly 20 includes a support 210, a repetition lever 240, the jack 250, and the torsion coil spring 280 which is a spring element. The support 210 and the repetition lever 240 are coupled together via a flexible portion 220. By the flexible portion 220, the repetition lever 240 is rotatably supported with respect to the support 210. The support assembly 20, except the torsion coil spring 280 and cushioning materials or the like (such as nonwoven fabric or spring element) provided at a portion which collides with another member, is a resin-made structure manufactured by injection molding. In this example, the support 210 and the repetition lever 240 are integrally formed. Note that the support 210 and the repetition lever 240 may be formed as individual components and be attached or bonded together.

The support 210 has one end side where a through hole 2109 is formed, and has the other end side where a jack support portion 2105 is formed. Between the through hole 2109 and the jack support portion 2105, the support 210 includes a support heel 212 projecting downward and a spring support portion 218 projecting upward. Through the hole 2109, a shaft supported by the support flange 290 is drawn. With this, the support 210 is rotatably disposed with respect to the support flange 290 and the frame 920. Therefore, the through hole 2109 serves as a rotation center of the support 210.

The support heel 212 has its lower surface which makes contact with the above-described capstan screw 120. The spring support portion 218 fixed to the support 210 supports the torsion coil spring 280. The jack support portion 2105 rotatably supports the jack 250. Therefore, the jack support portion 2105 serves as a rotation center of the jack 250.

Between the through hole 2109 (rotation center of the support 210) and the jack support portion 2105 (rotation center of the jack 250), a space is formed on a jack support portion 2105 side from the support heel 212. For convenience of description, the support 210 is sectioned into regions: a first main body portion 2101, a bent portion 2102, and a second main body portion 2103, from a through hole 2109 side. In this case, by the bent portion 2102 which couples the first main body portion 2101 and the second main body portion 2103 together, the second main body portion 2103 is disposed on a side closer to the key 110 (downward) than the first main body portion 2101. The jack support portion 2105 projects upward from the second main body portion 2103. According to this sectioning, the above-described space corresponds to a region interposed between the bent portion 2102 and the jack support portion 2105 above the second main body portion 2103. Also, at an end of the support 210 (an end on a second main body portion 2103 side), a stopper 216 couples. The support heel 212 is disposed below the bent portion 2102. Here, it is preferred that a distance from the key 110 to the second main body portion 2103 be longer than a distance from the key 110 to the support heel 212 (that is, the length of the capstan screw 130). This makes the capstan screw 130 easily adjustable from a player's side.

To the repetition lever 240, a spring contact portion 242 and an extension portion 244 are coupled. The spring contact portion 242 makes contact with a first arm 2802 of the torsion coil spring 280. The repetition lever 240 and the extension portion 244 include two plate-shaped members for interposition from sides of both side surfaces of the jack 250. In this example, the extension portion 244 and the jack 250 slidably make contact with each other in at least part of a space interposed between these two plate-shaped members. Also, the spring contact portion 242 is a protrusion which projects from the repetition lever 240. In one embodiment, the repetition lever 240 and the spring contact portion 242 are integrally formed.

The spring contact portion 242 is described in detail by using FIG. 3C. FIG. 3C is a partially enlarged view of the spring contact portion 242 in a region X1 of FIG. 3A viewed in a D1 direction. The spring contact portion 242 is configured of a spring contact top portion 2421 and two spring contact side portion 2423 and spring contact side portion 2425 interposing the spring contact top portion 2421. The spring contact top portion 2421 includes a curved-surface portion 2422 at a portion of the spring contact top v 2421 which receives a force from the first arm 2802 to rotate the repetition lever 240. When the repetition lever 240 rotates, the first arm 2802 slidably moves on the curved-surface portion 2422. Here, since the first arm 2802 extends along a tangent line of the curved-surface 2422, the first arm 2802 and the curved-surface portion 2422 have a contact area which is very small, almost a point contact.

The spring contact side portion 2423 and the spring contact side portion 2425 regulate movement of the first arm 2802 to a side-surface direction. Of the spring contact side portion 2423 and the spring contact side portion 2425, a surface which regulates movement of the first arm 2802 to the side-surface direction may form a curved surface. With this, as with the curved-surface portion 2422, a contact area with the first arm 2802 can also be reduced. Since a portion below the curved-surface portion 2422 is open, the first arm 2802 can be easily hooked to the spring contact portion 242.

The extension portion 244 includes an inner portion 2441, an outer portion 2442, a coupling portion 2443, and a stopper contact portion 2444. The inner portion 2441 is coupled to the repetition lever 240 on a deeper side from a player (flexible portion 220 side) of a large jack 2502. At a portion where the inner portion 2441 and the repetition lever 240 are coupled together, a rib 246 is provided. The inner portion 2441 interposes the large jack 2502 to cross to extend to a player's forward side (opposite side to the flexible portion 220) of the large jack 2502. At a portion of the intersection between the inner portion 2441 and the large jack 2502, the inner portion 2441 includes a linear-shaped protrusions P1 projecting to a large jack 2502 side.

The outer portion 2442 is coupled to the repetition lever 240 on a player's forward side (opposite side to the flexible portion 220) of the jack 250 (large jack 2502). The inner portion 2441 and the outer portion 2442 are coupled together at the coupling portion 2443. The coupling portion 2443 interposes a small jack 2504. The stopper contact portion 2444 couples to the coupling portion 2443, and makes contact with the stopper 216 from below. According to this, the rotation range in a direction in which the repetition lever 240 and the support 210 spread is regulated.

The jack 250 includes the large jack 2502, the small jack 2504, and a projecting portion 256. The jack 250 is rotatably disposed with respect to the support 210. Between the large jack 2502 and the small jack 2504, a support connecting portion 2505 to be rotatably supported by the jack support portion 2105 is formed. The support connecting portion 2505 has a shape surrounding part of the jack support portion 2105, and regulates a rotation range of the jack 250. Also, with the shape of the support connecting portion 2505 and elastic deformation of its material, it is possible to fit the support connecting portion 2505 of the jack 250 into the jack support portion 2105 from above the jack support portion 2105. The projecting portion 256 projects from the large jack 2502 to a side opposite to the small jack 2504, and rotates with the jack 250. The projecting portion 256 includes, on its side surface, a spring contact portion 2562. The spring contact portion 2562 makes contact with a second arm 2804 of the torsion coil spring 280.

The large jack 2502 includes linear-shaped protrusions P2 projecting from both side surfaces. The protrusions P2 slidably contact the protrusions P1 of the inner portion 2441 described above. The small jack 2504 includes circular-shaped protrusions P3 projecting from both side surfaces. The protrusions P3 slidably contact an inner surface of the coupling portion 2443 described above. As such, with the jack 250 and the extension portion 244 slidably contacting each other via the protrusions P1, P2, and P3, a contact area is decreased. Note that a grease reservoir may be formed by forming a groove portion by a plurality of protrusions P2. Also, a protrusion or groove portion may be formed in a side-surface of the large jack 2502.

In the torsion coil spring 280, the spring support portion 218 is taken as a fulcrum, the first arm 2802 makes contact with the spring contact portion 242, and the second arm 2804 makes contact with the spring contact portion 2562. The first arm 2802 functions as an spring element which provides a rotational force to the repetition lever 240 via the spring contact portion 242 so as to move a player's side of the repetition lever 240 upward (in a direction away from the support 210). The second arm 2804 functions as an spring element which provides a rotational force to the jack 250 via the spring contact portion 2562 so as to move the projecting portion 256 downward (to a support 210 side).

Figure 4:
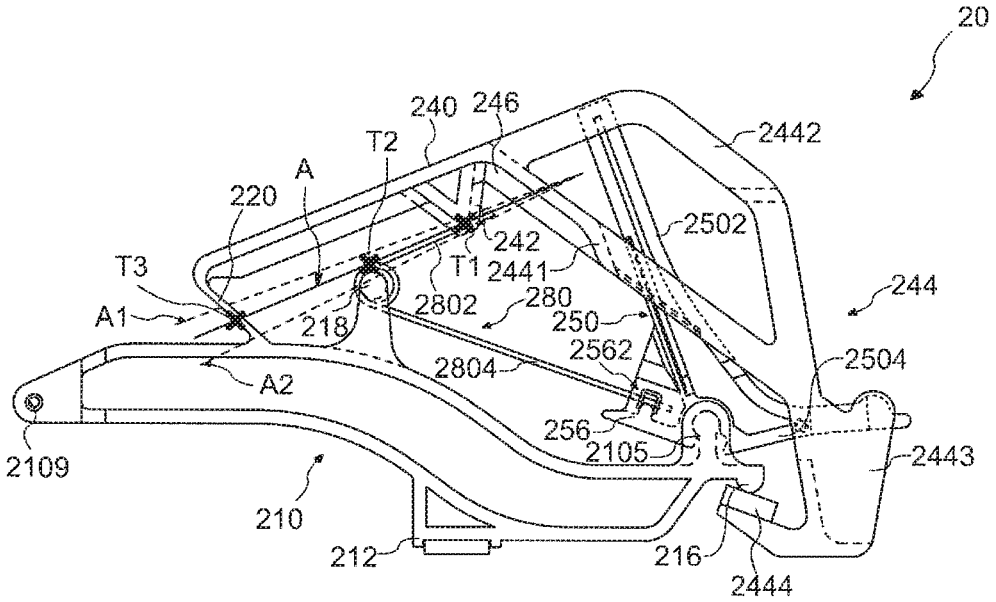
FIG. 4 is a side view depicting a positional relation of each structure of the support assembly in one embodiment of the present invention.

FIG. 4 is a side view depicting a positional relation of each structure of the support assembly in one embodiment of the present invention. In the present embodiment, the spring contact portion 242 is provided at the protrusion provided to the repetition lever 240. At the protrusion, the spring contact portion 242 functions as a point of action of the repetition lever. The first arm 2802, which is a spring element, is a straight-line-shaped member, and may be slightly bent in accordance with rotation of the repetition lever 240.

At the position of the repetition lever 240 when the key 110 is not pressed down (hereinafter referred to as an initial position), a point of action T1 (a contact point between the first arm 2802 and the spring contact top portion 2421) of the first arm 2802 onto the repetition lever 240, a fulcrum (spring support portion 218) T2 of the first arm 2802, and a rotation center T3 (flexible portion 220) of the repetition lever 240 have a specific positional relation. The specific positional relation is a relation where the rotation center T3 is disposed on a straight line A connecting the point of action T1 and the fulcrum T2. That is, the rotating portion of the repetition lever 240 is provided on an extension line of a straight line connecting the spring support portion 218 and the spring contact section 242. The rotating portion has a function of rotating the repetition lever 240, and includes a rotation center and a shaft. That is, as depicted in FIG. 4, the rotating portion of the repetition lever 240 is provided on a rotation center side of the support 210 with respect to the spring contact portion 242. In the present embodiment, the rotating portion of the repetition lever 240 is provided on a side opposite to a contact portion between the repetition lever 240 and the first arm 2802 with respect to the spring support portion 218.

Note that the rotating portion is present in the flexible portion 220, and includes a flexible region that is locally more flexible than neighbouring regions. Also, the flexible portion 220 may be configured of a spring element. With the rotating portion having the structure as described above, the structure of the support assembly 20 can be simplified.

With this specific positional relation, the repetition lever 240 and the first arm 2802 rotate with a substantially parallel state being kept, and therefore the elastic force of the first arm 2802 is efficiently transmitted to the spring contact portion 242. In the present embodiment, a position is present where the point of action T1 is pressed down with rotation of the repetition lever 240 to cause the first arm 2802, which is a spring element, and the repetition lever to become parallel to each other. Also, the amount of sliding between the first arm 2802 and the curved-surface portion 2422 when the repetition lever 240 rotates by a predetermined angle from the initial position can also be reduced. Note that the specific positional relation is not restricted to be achieved at the initial position, but may be achieved in the rotation range of the repetition lever 240. As depicted in FIG. 4, the straight line A is present in a range from a straight line A1 to a straight line A2, and the rotation center T3 of the repetition lever 240 is a point of inter portion of the straight line A and the flexible portion 220. Therefore, the rotation center T3 of the repetition lever 240 is present from a point of intersection of the straight line A1 and the flexible portion 220 to a point of intersection of the straight line A2 and the flexible portion 220. In one embodiment, the repetition lever and a straight-line-shaped portion of the spring element are positioned at an angle in a range equal to or larger than 0° and equal to or smaller than 20°.

[Operation of Support Assembly 20]

Next, the support assembly 20 is described when the key 110 is pressed down from the rest position (FIG. 1) to the end position.

Figure 5:
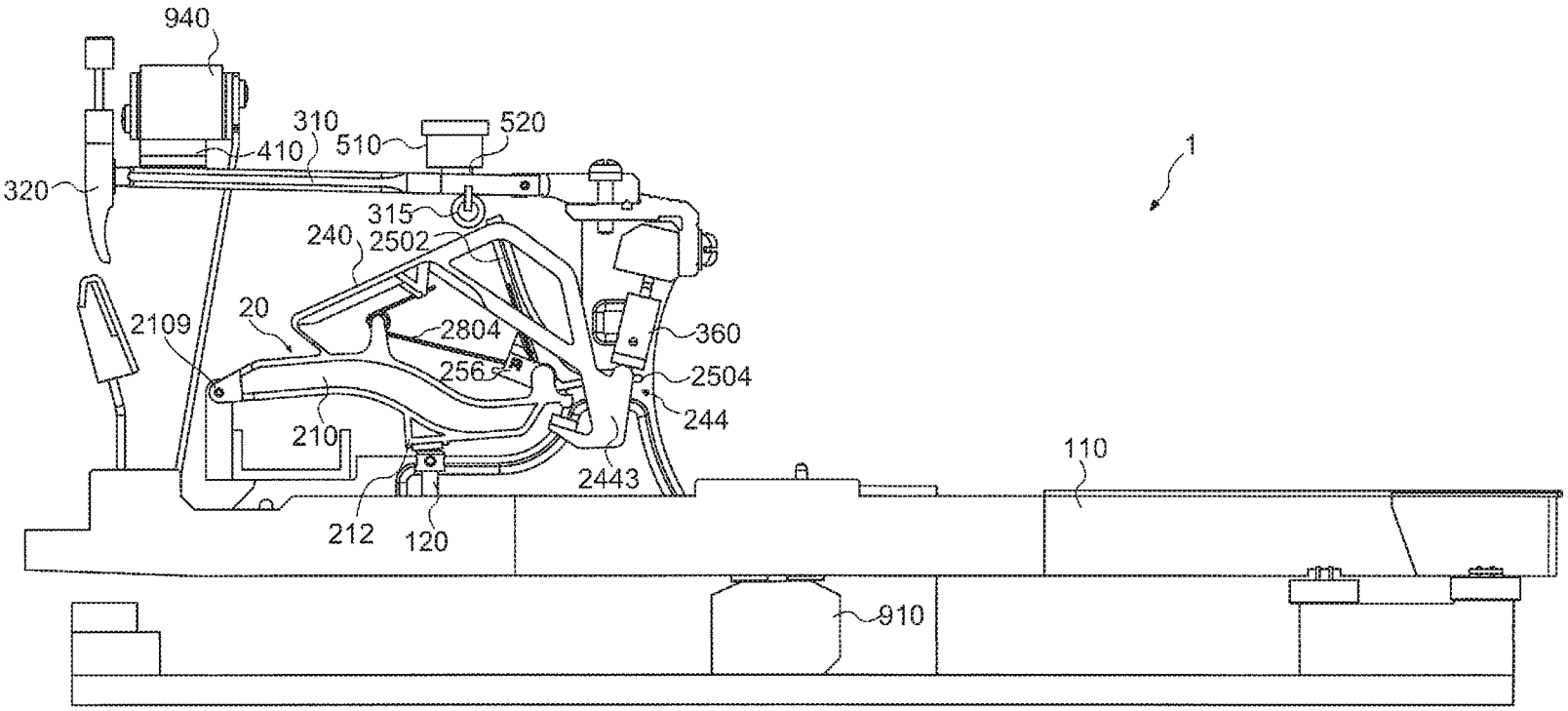
FIG. 5 is a side view for describing movement of the support assembly in one embodiment of the present invention.

FIG. 5 is a side view for describing movement of the support assembly in one embodiment of the present invention. When the key 110 is pressed down to the end position, the capstan screw 120 pushes up the support heel 212 to rotate the support 210, with the axis of the through hole 2109 taken as a rotation center. When the support 210 rotates to move upward, the large jack 2502 pushes up the hammer roller 315 to cause the hammer shank 310 to collide with the hammer stopper 410. Note that this collision corresponds to string hammering by a hammer in a conventional grand piano.

Immediately before this collision, while upward movement of the small jack 2504 is regulated by the regulating button 360, the support 210 (jack support portion 2105) further ascends. Therefore, the large jack 2502 rotates so as to go off from the hammer roller 315. Here, by the regulating button 360, upward movement of the coupling portion 2443 is also regulated. In this example, the regulating button 360 has also a function of a repetition regulating screw in the action mechanism in a conventional grand piano.

This regulates upward movement of the repetition lever 240, which rotates so as to approach the support 210. With these operations, a double escapement mechanism is achieved. FIG. 5 is a drawing depicting this state. Note that when the key 110 is being returned to the rest position, the hammer roller 315 is supported by the repetition lever 240, and the large jack 2502 is returned below the hammer roller 315. A rotational force to cause the large jack 2502 to be returned below the hammer roller 315 is provided by the second arm 2804 via the projecting portion 256.

Figure 6A:
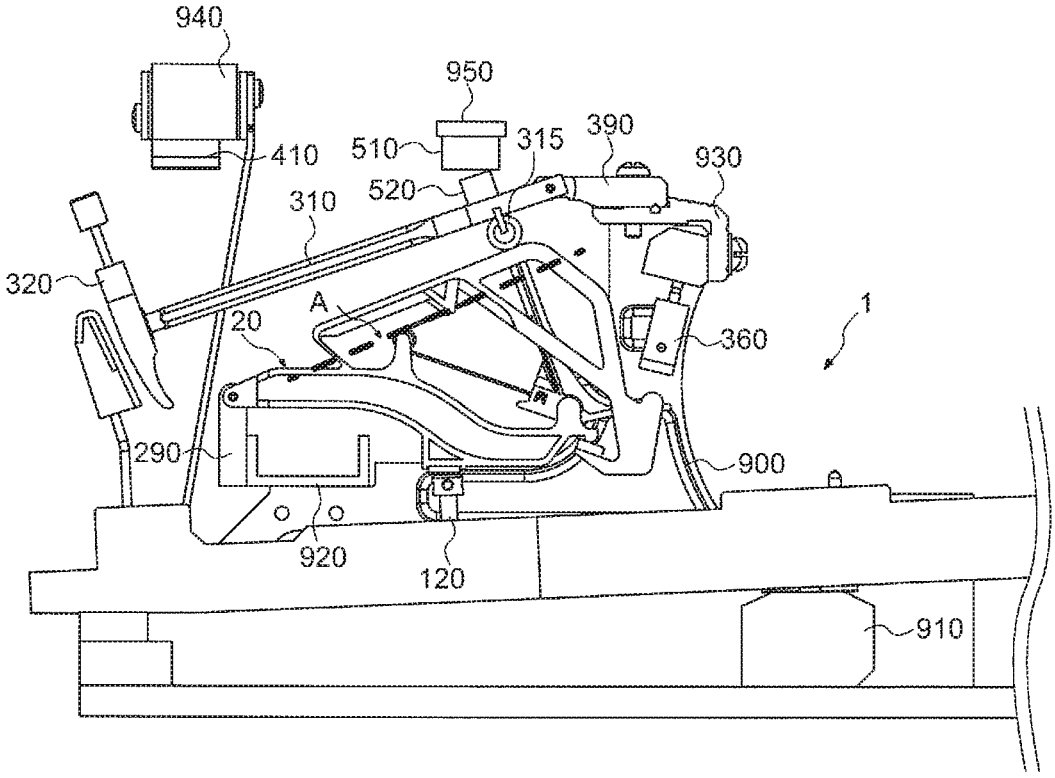
FIG. 6A is a side view for describing movement of the support assembly in one embodiment of the present invention.
Figure 6B:
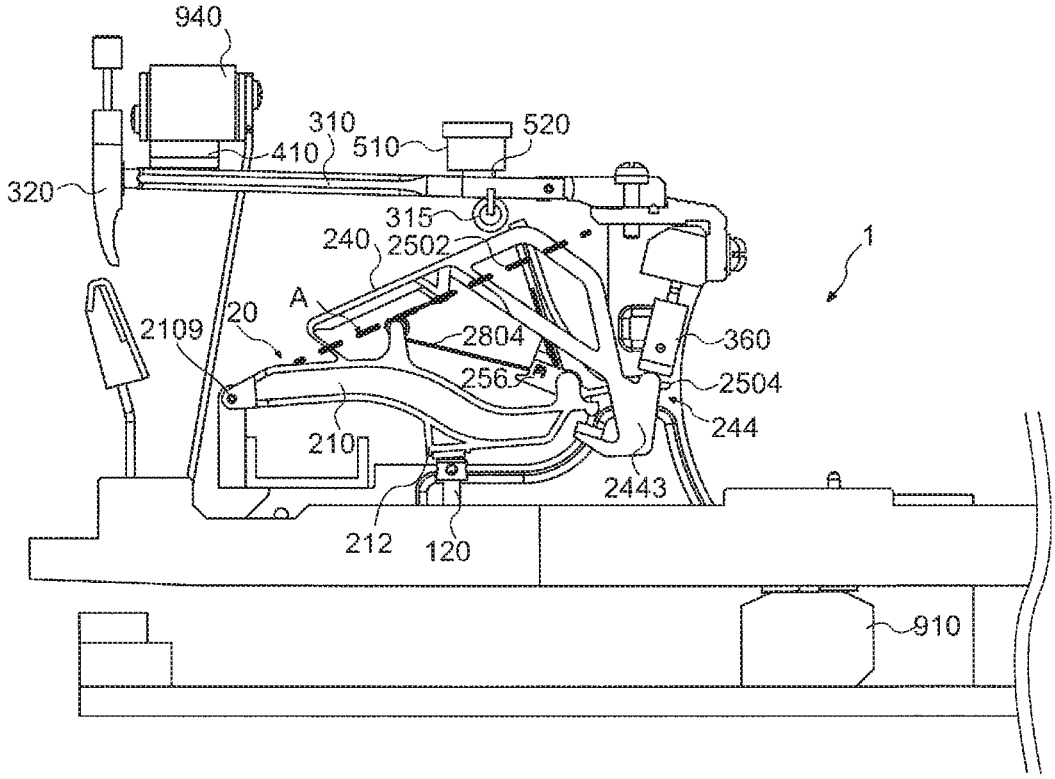
FIG. 6B is a side view for describing movement of the support assembly in one embodiment of the present invention.

Here, FIG. 6A and FIG. 6B is referred to. FIG. 6A and FIG. 6B depicts side views for describing movement of the support assembly in one embodiment of the present invention. FIG. 6A depicts the state in which the key 110 is not pressed down, and FIG. 6B depicts the state in which the key 110 is pressed down to the end position. In comparison between FIG. 6A and FIG. 6B, it is evident that the rotating portion of the repetition lever 240 is provided on an extension line between the spring support portion 218 and the spring contact portion 242.

As such, since a double escapement is achieved with a structure simpler compared with the support assembly for use in a conventional grand piano, manufacturing cost can be reduced while decreasing influences on touch feeling.

[Sound Emission Mechanism of Keyboard Apparatus 1]

As described above, the keyboard apparatus 1 is an example of application to an electronic piano. The operation of the key 110 is measured by the sensor 510, and a sound in accordance with the measurement result is outputted.

Figure 7:
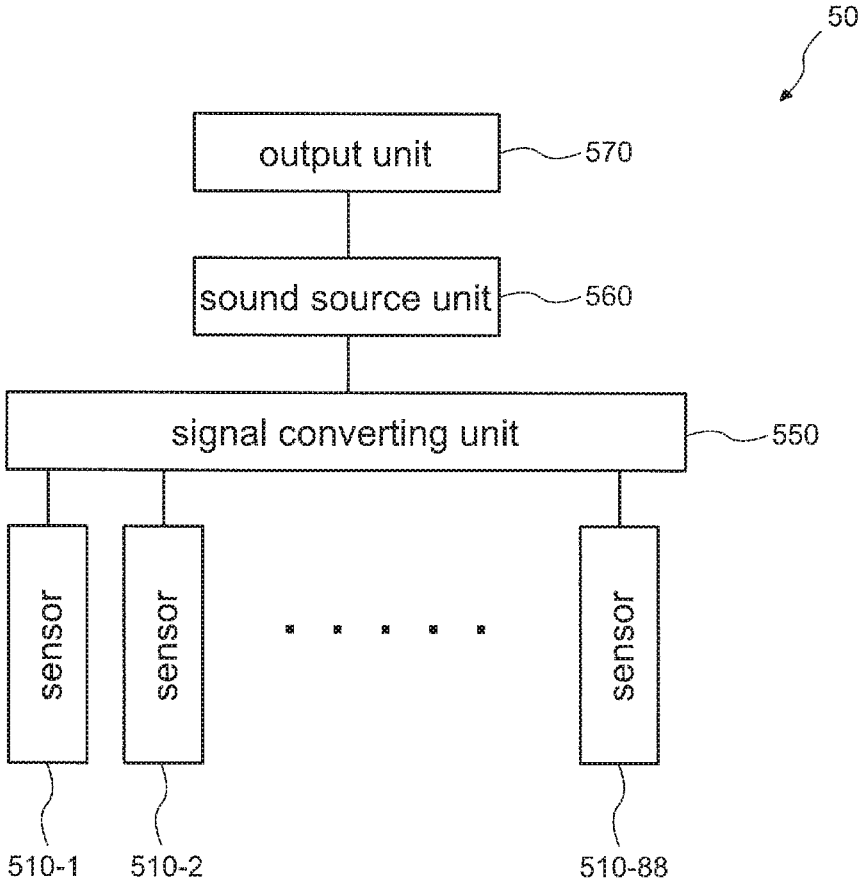
FIG. 7 is a block diagram depicting the structure of a sound emission mechanism of the keyboard apparatus according to one embodiment of the present invention.

FIG. 7 is a block diagram depicting the structure of a sound emission mechanism of the keyboard apparatus according to one embodiment of the present invention. A sound emission mechanism 50 of the keyboard apparatus 1 includes the sensors 510 (sensors 510-1, 510-2, . . . 510-88 for the eighty-eight keys 110), a signal converting unit 550, a sound source unit 560, and an output unit 570. The signal converting unit 550 obtains an electric signal outputted from the sensor 510, and generates and outputs an operation signal in accordance with an operating state in each key 110. In this example, the operation signal is a MIDI-format signal. Therefore, in accordance with the timing when the hammer shank 310 collides with the hammer stopper 410 by key-pressing operation, the signal converting unit 550 outputs Note ON. Here, a key number indicating which of the eighty-eight keys 110 has been operated and velocity for a speed immediately before the collision are also outputted in association with Note ON. On the other hand, when key-releasing operation is performed, in accordance with the timing when string vibrations are stopped by a damper in the case of a grand piano, the signal converting unit 550 outputs the key number and Note OFF in association with each other. To the signal converting unit 550, a signal for another operation such as one on a pedal may be inputted and reflected to the operation signal. The sound source unit 560 generates a sound signal based on the operation signal outputted from the signal converting unit 550. The output unit 570 is a loudspeaker or terminal which outputs the sound signal generated by the sound source unit 560.

In the above-described embodiment, an electronic piano is described as an example of a keyboard apparatus to which a support assembly is applied. On the other hand, the support assembly of the above-described embodiment can be applied to a grand piano (acoustic piano). In this case, the sound emission mechanism corresponds to a hammer and a string. The string generates a sound by being struck by a hammer in accordance with key pressing.

According to one embodiment of the present invention, compared with a keyboard apparatus of an acoustic piano, manufacturing cost of the support assembly can be reduced while a change in touch feeing at the time of key operation is decreased.

The invention claimed is:

1. A support assembly comprising:

a support rotatably disposed with respect to a frame;

a repetition lever rotatably connected to the support via a flexible portion;

a spring element supported by a spring support portion fixed to the support, the spring element providing a rotational force to the repetition lever; and a contact portion between the repetition lever and the spring element, wherein a rotating portion of the repetition lever is provided with respect to the spring support portion on a side opposite to the contact portion between the repetition lever and the spring element, the rotating portion including a rotation center on the flexible portion of the repetition lever, and when the support rotates away from the frame and the repetition lever rotates toward the support, the spring support portion is displaced between the contact portion and the flexible portion toward the flexible portion from the contact portion.

2. The support assembly according to claim 1, wherein the rotating portion of the repetition lever is provided on an extension line of a straight line connecting the spring support portion and the contact portion.

3. The support assembly according to claim 1, wherein in a rotation range of the repetition lever, a position is provided where the repetition lever and the spring element become parallel to each other.

4. The support assembly according to claim 1, wherein the spring element is a straight-line-shaped member.

5. The support assembly according to claim 4, wherein in a rotation range of the repetition lever, the repetition lever and the straight-line-shaped member of the spring element are positioned at an angle in a range equal to or larger than 0° and equal to or smaller than 20°.

6. The support assembly according to claim 1, wherein the support includes a resin structure.

7. The support assembly according to claim 1, comprising:

a jack including a resin structure.

8. A keyboard apparatus comprising:

a plurality of the support assemblies according to claim 1; and keys disposed correspondingly to respective support assemblies among the plurality of the support assemblies to rotate respective supports among the supports of the respective support assemblies.

9. The keyboard apparatus according to claim 8, comprising:

a sound output unit for outputting a sound signal generated in accordance with key pressing of a key among the keys.

10. The keyboard apparatus according to claim 9, wherein the sound output unit comprises:

a loudspeaker for outputting the sound signal generated in accordance with key pressing of a key among the keys.

11. The keyboard apparatus according to claim 9, wherein the sound output unit comprises:

a terminal for outputting the sound signal generated in accordance with key pressing of a key among the keys.

12. The keyboard apparatus according to claim 8, comprising:

a string for generating a sound by being struck by a hammer in accordance with key pressing of a key among the keys.

13. A support assembly comprising:

a support rotatably disposed with respect to a frame;

a repetition lever rotatably connected to the support via a flexible portion;

a spring element supported by a spring support portion fixed to the support, the spring element providing a rotational force to the repetition lever; and a contact portion between the repetition lever and the spring element, wherein a rotating portion of the repetition lever is provided with respect to the spring support portion on a side opposite to the contact portion between the repetition lever and the spring element, the contact portion includes a protrusion projecting from the repetition lever, the protrusion making contact with the spring element, the rotating portion including a rotation center on the flexible portion of the repetition lever, and when the support rotates away from the frame and the repetition lever rotates toward the support, the spring support portion is displaced between the contact portion and the flexible portion toward the flexible portion from the contact portion.

14. A support assembly comprising:

a support rotatably disposed with respect to a frame;

a repetition lever rotatably connected to the support;

a spring element supported by a spring support portion fixed to the support, the spring element providing a rotational force to the repetition lever; and a contact portion between the repetition lever and the spring element, wherein a rotating portion of the repetition lever is provided with respect to the spring support portion on a side opposite to the contact portion between the repetition lever and the spring element, the rotating portion of the repetition lever includes a region with flexibility, the support and the repetition lever being constantly coupled together via the region with flexibility, the rotating portion including a rotation center on the region with flexibility of the repetition lever, and when the support rotates away from the frame and the repetition lever rotates toward the support, the spring support portion is displaced between the contact portion and the region with flexibility toward the region with flexibility from the contact portion.

15. The support assembly according to claim 14, wherein the region with flexibility of the repetition lever includes another spring element.

16. A support assembly comprising:

a support rotatably disposed with respect to a frame;

a repetition lever rotatably connected to the support via a rotating portion;

a spring element supported by a spring support portion fixed to the support, the spring element providing a rotational force to the repetition lever; and a contact portion between the repetition lever and the spring element, wherein the rotating portion of the repetition lever is provided with respect to the spring support portion on a side opposite to the contact portion between the repetition lever and the spring element, the rotating portion including a rotation center of the repetition lever, and when the support rotates away from the frame and the repetition lever rotates toward the support, the rotating portion of the repetition lever is provided on an extension line of a straight line connecting the spring support portion and the contact portion.

17. The support assembly according to claim 16, wherein in a rotation range of the repetition lever, a position is provided where the repetition lever and the spring element become parallel to each other.

18. The support assembly according to claim 16, wherein the spring element is a straight-line-shaped member.

19. The support assembly according to claim 18, wherein in a rotation range of the repetition lever, the repetition lever and the straight-line-shaped member of the spring element are positioned at an angle in a range equal to or larger than 0° and equal to or smaller than 20°.

20. A keyboard apparatus comprising:

a plurality of the support assemblies according to claim 16; and keys disposed correspondingly to respective support assemblies among the plurality of the support assemblies to rotate respective supports among the supports of the respective support assemblies.

* * * * *